US005125303A

United States Patent [19]

Hoyland

[11] Patent Number: 5,125,303

[45] Date of Patent: Jun. 30, 1992

[54] COMBINED JUMP CONVEYOR AND SLICING MACHINE

[75] Inventor: Trevor B. Hoyland, Norfolk, England

[73] Assignee: Thurne Engineering Co., Ltd., England

[21] Appl. No.: 524,897

[22] Filed: May 18, 1990

[30] Foreign Application Priority Data

May 19, 1989 [GB] United Kingdom ..... 8911523

[51] Int. Cl.[5] ..... B26D 7/32

[52] U.S. Cl. ..... 83/76.8; 83/88; 83/155; 83/360; 53/517

[58] Field of Search ..... 83/72, 73, 76.1, 76.7, 83/76.8, 76.6, 79, 80, 88, 90, 155, 363, 367, 360; 53/517, 504; 198/371, 418.9, 419.2, 502.2; 364/469, 572, 474.09

[56] References Cited

U.S. PATENT DOCUMENTS

| | | | |
|---|---|---|---|
| 3,010,499 | 11/1961 | Dahms et al. | 53/517 X |
| 3,133,571 | 5/1964 | Hensgen et al. | 83/72 X |
| 4,379,416 | 4/1983 | Kuchler | 83/88 X |
| 4,541,824 | 9/1985 | Muller | 198/371 X |
| 4,580,475 | 4/1986 | Antonissen | 83/73 X |
| 4,585,227 | 4/1986 | Muller | 198/418.9 X |

*Primary Examiner*—Frank T. Yost
*Assistant Examiner*—Eugenia A. Jones
*Attorney, Agent, or Firm*—Sughrue, Mion, Zinn Macpeak & Seas

[57] ABSTRACT

A combined jump conveyor and slicing machine includes a jump conveyor formed by a first short conveyor (1) adjacent the slicing blade (3) of the slicing machine having a length substantially equal to the length of one or two shingled slices in the shingled direction and a second conveyor (2) downstream of the first conveyor (1). Both conveyors (1 and 2) of the jump conveyor have an independent drive (7,8) and a controller (9) to drive the two conveyors at the same speed or at different speeds. The independent drive (7) and controller (9) of the first conveyor (1) also enable it to be driven at high speed in the reverse direction away from the second conveyor (2) to reject slices cut by the slicing blade (3). The slicing machine and jump conveyor combination preferably includes a sensor (10) which detects the height of a log (5) to be cut immediately upstream of the slicing blade (3) of the slicer and means to control the low shingling speed of the jump conveyor (1) in accordance with the output of the sensor (10) to provide groups of shingled slices of constant length in the shingling direction.

7 Claims, 3 Drawing Sheets

STACK PACK
ZERO
SHINGLE SPEED
REVERSE SHINGLE SPEED FOR STACK PACK PRESENTATION
TRANSFER FROM CONV1 TO 2
JUMP SPEED
LINE SPEED
TRANSFER TO PACKAGING LINE
V
T
CONVEYOR 1
CONVEYOR 2

SHINGLE PACK
ZERO
SHINGLE SPEED
TRANSFER FROM CONV1 TO 2
JUMP SPEED
LINE SPEED
SHINGLE SPEED
TRANSFER TO PACKAGING LINE
V
T

MAX. WIDTH SLICE
FIXED SHINGLE SPEED

MIN. WIDTH SLICE
FIXED SHINGLE SPEED

MIN. WIDTH SLICE
VARIABLE SHINGLE SPEED

COMBINED JUMP CONVEYOR AND SLICING MACHINE

BACKGROUND OF THE INVENTION

In slicing foodstuffs a slicing machine is used to cut slices from a block of meat or meat product or a prism of cheese at a constant repetition rate. The cut slices fall onto what is known as a jump conveyor which, typically moves forwards at a slow speed to provide a shingle of slices and then, after a predetermined number of slices or a predetermined weight of foodstuff has been cut, accelerates and travels briefly at high speed. Early examples of jump conveyors such as disclosed in U.S. Pat. No. 3,910,141 also stop the feed of foodstuff towards the blade at this time to allow sufficient time for the "jump" operation to occur to separate one shingled group of slices from the next. However, more recently jump conveyors have been arranged to have a faster jump operation so that the jump operation is carried out entirely in the interval between the cutting of consecutive slices. Such jump conveyors are typically driven from two separate drives, a high speed drive and a low speed drive both of which run continuously. One or other of the drives is clutched to the conveyor to drive the conveyor at low or high speed.

It is also known to drive a jump conveyor via a hydraulic motor and to throttle the flow through the hydraulic motor to provide the slow speed. Another form of jump conveyor is described in our EP-A-0233008. This jump conveyor comprises two separate multi-element strip conveyors which are interleaved with one another. One conveyor runs at slow speed and is located at a fixed position in space whilst the other conveyor runs at high speed and is movable bodily upwards and downwards. Typically both conveyors run continuously and, after the slow speed conveyor has collected the required group of slices the high speed conveyor is moved up rapidly to engage the base of the group of slices and carry it away at high speed. The high speed conveyor is then lowered again so that the following slice falls on the low speed conveyor. EP-A-0233008 also discloses that the slow speed conveyor may be held stationary or even move slowly in the reverse direction to build up a group of slices into a stack.

Typically a jump conveyor is followed by another conveyor which forms part of a downstream packaging line. In U.S. Pat. No. 3,910,141 this following conveyor runs at a higher speed than the jump conveyor so that the separation between the groups of slices is increased as they are transferred onto the following conveyor.

A slicing machine capable of high speed operation can cut as many slices as 1200 per minute. It is usually the jump conveyor which provides the limitation on the slicing speed because as the slicing speed of the slicer increases so the time interval between consecutive slices gets shorter and this means that the jump conveyor has less time to separate one group from another. With the jump conveyors described above most slicing machines operate in the region of up to 100 packs per minute and thus 100 shingled groups per minute but with the slicing machine described in EP-A-0233008 we have been able to reach speeds as high as 120–140 packs per minute but it is naturally desirable to be able to increase this speed still further.

SUMMARY OF THE INVENTION

According to a first aspect of this invention a combined jump conveyor and slicing machine includes a jump conveyor formed by first short conveyor adjacent the slicing blade of the slicing machine having a length substantially equal to the height capacity of the slicing machine and a second conveyor downstream of the first conveyor, both conveyors of the jump conveyor having an independent drive and control means to drive the two conveyors at the same speed or at different speeds, the independent drive and control means of the first conveyor also enabling it to be driven at high speed in the reverse direction away from the second conveyor to reject slices cut by the slicing blade.

With the arrangement in accordance with this invention the jump conveyor is formed by two separate conveyors, the first conveyor of which is short having a length which is approximately equal to that of the slices and cut by the slicing machine. When it is required that the slices be formed into groups having the form of a stack the first conveyor is held stationary or moved slowly in the reverse direction away from the second conveyor whilst the stack is accumulated on it. As explained in detail in specification EP-A-0233008 the flight path of the slices after they have been cut and before they land on the jump conveyor is curved and, therefore, to get an aligned stack, as the height of the stack increases the stack is moved closer to the slicing blade. Whilst the first conveyor is carrying out this manoeuvre the second conveyor is completely free to move at whatever speed is required, for example to move at the line speed to be able to transfer a preceding stack to a downstream packaging line without distortion. When the slicing machine is forming shingled groups then the first conveyor moves forwards slowly so that the slices are formed into a shingled group on it. Since the first conveyor is only the same length as a single slice the slices of a shingled group are longer than the first conveyor alone. Thus during shingling both the first and second conveyor move at the same slow forwards speed and, in this way, can accommodate a long shingle of slices.

As soon as the slicing of the group has been completed both the first and second conveyors are moved at high speed in the interval between the slicing of two consecutive slices to create a gap between successive groups. As soon as the group has left the first conveyor the first conveyor can again be slowed down, stopped or start moving slowly in the reverse direction so that it is ready to receive the first slice of the following group. Equally, as soon as the end of the group has passed onto the second conveyor the second conveyor can carry on at high speed or can be decelerated to match the line speed so that the sliced group of product is transferred to a downstream packaging line at the line speed of that product. When the jump conveyor is preparing shingled groups of slices the second conveyor slows down to the shingling speed as soon as it has transferred the preceding group so that it can again co-operate with the first conveyor to hold the next shingled group as it is cut.

The initial and final slices that are cut from a piece of meat or meat product tend to be irregularly shaped and tend not to be of the correct weight. Our co-pending patent application claiming priority from GB8911522 filed on the same day as this application and incorporated herein by reference describes a product slicing system in which the leading and trailing ends of each log of product are detected and in which the slices cut from the regions adjacent each end are rejected. Preferably such a product slicing system includes a combined slicing machine and jump conveyor in accordance with this invention and the first conveyor is run at high speed in the reverse direction to reject the slices cut from the end region of each log of product. Typically the high speed in the reverse direction is substantially the same speed that the jump conveyor moves to jump in the forwards direction. Acceptable products of the second conveyor are meanwhile transferred to the packaging line.

Preferably both the first and second conveyors of the jump conveyor have the form of multi-element strip conveyors, the ends of which are, at least to some extent, interleaved to obtain a smooth transfer of the product from the first to the second conveyor of the jump conveyor. Preferably both the first and second conveyors are driven by DC brushless motors which have a very high torque and are controllable to a high degree. In this way the motors, and hence the conveyors can be both accelerated and decelerated rapidly in the interval between the cutting of two consecutive slices by the slicing machine. Preferably the first and second conveyors and the operation of a slicing machine are all under the control of a programmed computer, or a programmed logic controller so that the timing of the speed changes of the first and second conveyor is directly coupled to the operation and slice cutting of the slicing machine.

When making shingled packs in the past the jump conveyor has a fixed slow shingling speed for each product that it handles. Since meat is a natural product size variations occur between different blocks or logs of product. The fixed shingling speed that is selected is thus determined as being the speed which, with the largest height of product likely to be cut the slices are spread out across the entire pack. However when the slicing machine is cutting a log with a smaller height this same fixed shingling speed does not spread the slices over the entire pack and this can give the impression to the eventual purchaser that the pack is not full even though it is, of course, of the correct weight.

According to a second aspect of this invention a slicing machine and jump conveyor combination includes a sensor which detects the height of a log to be cut immediately upstream of the slicing blade of the slicer and means to control the low shingling speed of the jump conveyor in accordance with the output of the sensor to provide groups of shingled slices of constant length in the shingling direction.

The jump conveyor may be one of the conventional types described in the introduction with a variable speed drive but preferably it is of the kind defined in the first aspect of this invention.

Preferably the control unit calculates the pitch P between adjacent slices of a shingle and hence the shingling speed of the jump conveyor using the following equation:

$$P = \frac{L - H}{n - 1}$$

where L is the required total length of the shingled pack, H is the height of the log and n is the number of slices in the pack.

The sensor for detecting the height of each log immediately upstream of the slicing blade may simply be formed by a feeler which engages the upper surface of the log and is connected to an encoder or potentiometer or, alternatively the sensor may be an ultrasonic or laser operated distance measuring device which measures the distance to the upper surface of the log and, from this measurement, derives the height of the log.

A slicing machine and jump conveyor combination in accordance with the first aspect of this invention is very much more versatile than any of the preceding arrangements since the product only has to clear the first short conveyor in the time interval between the cutting of consecutive slices. This is true whether the short conveyor is operated at high speed in the reverse direction to reject a slice or whether it moves at high speed in the forwards direction to form a separation between the adjacent groups of product. The separate second conveyor can, once decoupled from the first conveyor, then be slowed down to the line speed. We have found it possible to produce packs at speeds as high as 160 per minute with a combination in accordance with the present invention. A slicing machine and jump conveyor combination in accordance with the second aspect of this invention ensures a consistent filling of each pack irrespective of variations in the height of the log being sliced.

BRIEF DESCRIPTION OF THE DRAWINGS

A particular example of a jump conveyor and slicing machine combination in accordance with this invention will now be described with reference to the accompanying drawings, in which.

DESCRIPTION OF PREFERRED EXAMPLE

Figure 1:
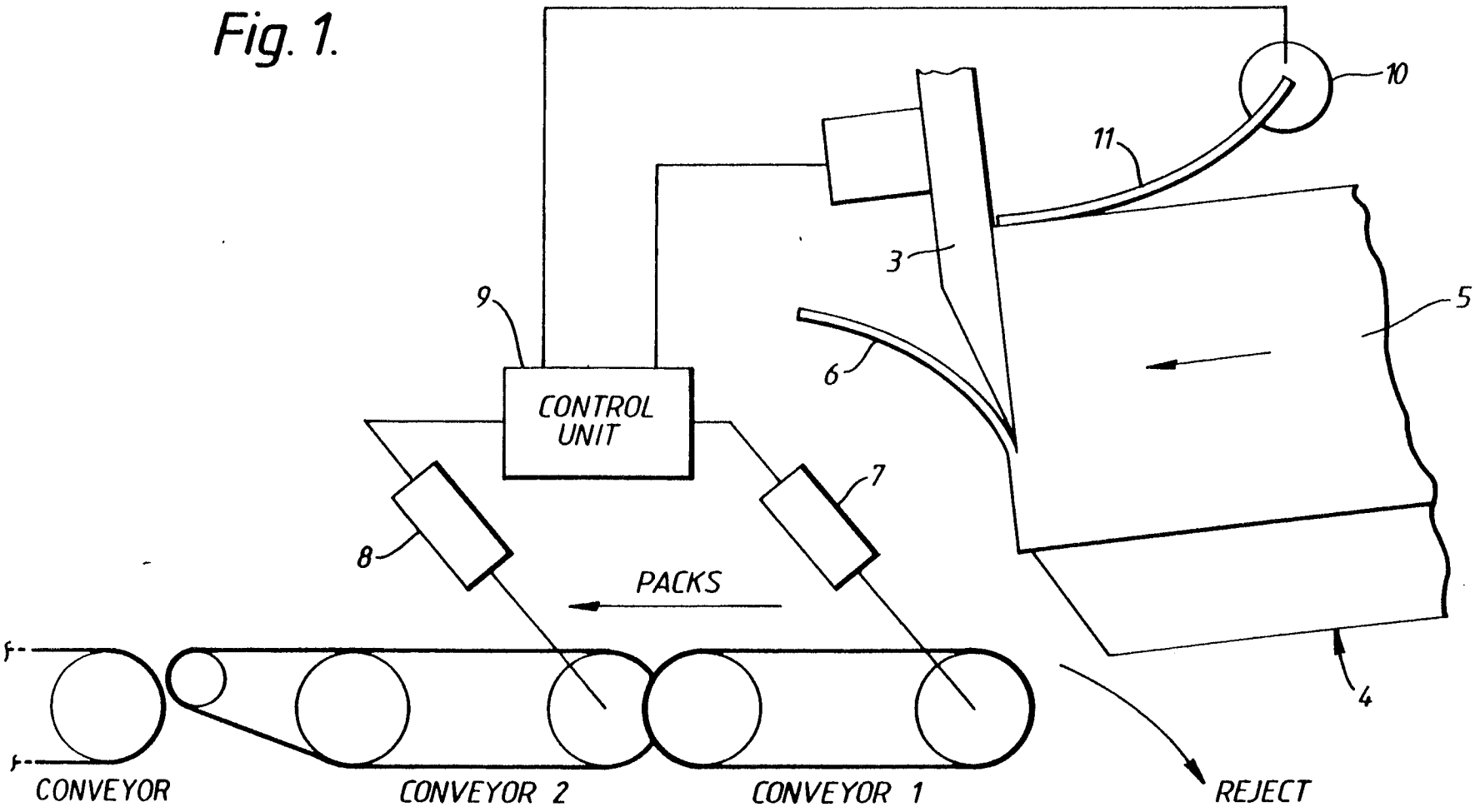
FIG. 1 is a diagrammatic view of a slicing machine and jump conveyor combination.

A combination in accordance with this invention comprises a jump conveyor formed by a first conveyor 1 and a second, downstream conveyor 2, arranged to receive slices cut by the slicing blade 3 of a slicing machine indicated generally by reference numeral 4. The slicing machine is conventional in construction and is a standard "Polyslicer" manufactured by Thurne Engineering Company Limited of Delta Close, Norwich, Norfolk. The slicing machine 4 cuts a log 5 of product which is .moved forwards, to the left as shown in FIG. 1, continuously by a drive, not shown. Slices 6 cut from the face of the log 5 fall onto the upper surface of conveyor 1 and substantially fill it. The conveyors 1 and 2 are driven by brushless DC motors 7 and 8 and are controlled independently by a control unit 9.

Figure 2:
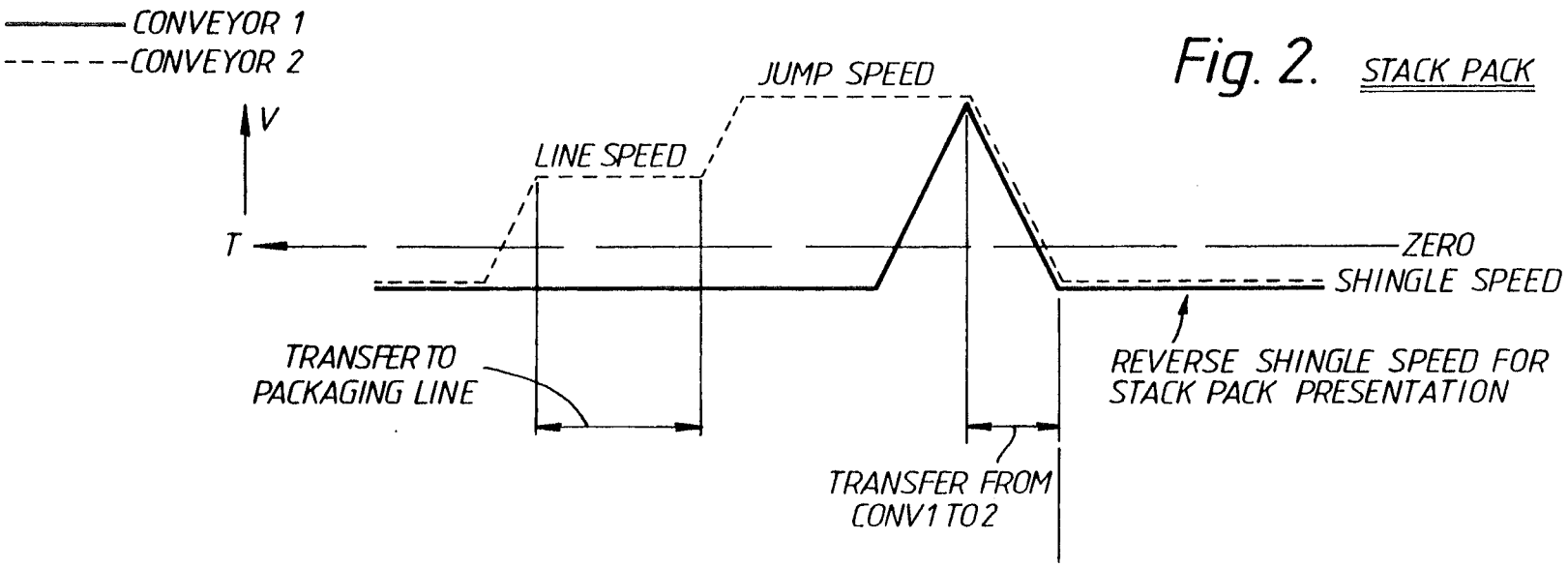
FIG. 2 is a speed diagram showing the speed of the two jump conveyors when forming a pack stack.

FIG. 2 illustrates the way in which the speed of the two conveyors 1 and 2 are controlled when forming a stacked pack and, reading the speed diagram from right to left both conveyors first of all move slowly in the reverse direction, that is from left to right as shown in FIG. 1 and as indicated by the negative speed in FIG. 2. Note that the speed of the conveyor 2 is shown by a dotted line whilst the speed of conveyor 1 is shown by a solid line. Once the stack is formed with the required number of slices, conveyors 1 and 2 are both speeded up with the same acceleration and the stack is transferred from conveyor 1 to conveyor 2 during this period. Conveyor 1 then decelerates equally rapidly and returns to the slow speed in the reverse direction. Conveyor 2 is held at the highest speed that is reached for a period to provide a substantial separation of the pack from the following pack and is then slowed down to the speed of the packaging line. The pack is transferred from the conveyor 2 to the packaging line whilst their speeds are matched and then, subsequently, the speed of conveyor 2 is matched to that of conveyor 1 and hence moved slowly in the reverse direction. The process is then repeated for the next stack of slices.

All the while that the first conveyor 1 is operating at a slow speed in the reverse direction it is capable of receiving slices 6 cut by the slicing machine 4 and forming them into stacks, it is only during the short acceleration and deceleration which takes place in the interval between the cutting of two consecutive slices that the first conveyor is operated at a different speed. However. the second conveyor operates at high speed firstly to establish a gap between one stack and another stack of products and secondly is operated at the line speed so that a smooth transfer of product takes place to a downstream packaging line.

Figure 3:
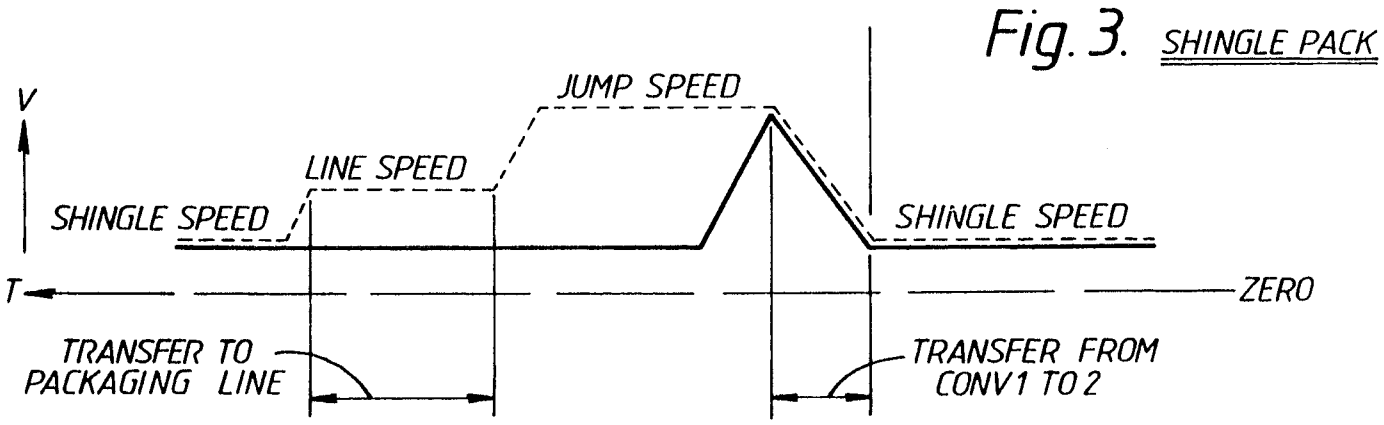
FIG. 3 is a speed diagram of the two jump conveyors when forming a shingled pack.

When producing a shingle of slices as shown in FIG. 3 both conveyors 1 and 2 are run at slow speed in the forwards direction. As the shingle is formed the initially deposited slices are transferred onto the second conveyor 2 whilst further slices are still being added to the first conveyor 1. On completion of the pack, both conveyors are accelerated rapidly as the final slices of the pack are transferred from the first conveyor 1 to the second conveyor 2. The first conveyor 1 is then decelerated rapidly to return it to the slow forwards shingle speed whilst the second conveyor 2 is maintained at high speed to establish a substantial separation between one pack and the next. The second conveyor is then decelerated to line speed to enable the shingled group of slices to be transferred from the second conveyor to a downstream packaging line before returning to the shingling speed to be able to receive the initial slices of the following pack as they are transferred from the first conveyor 1 to the second conveyor 2.

Figure 4A:
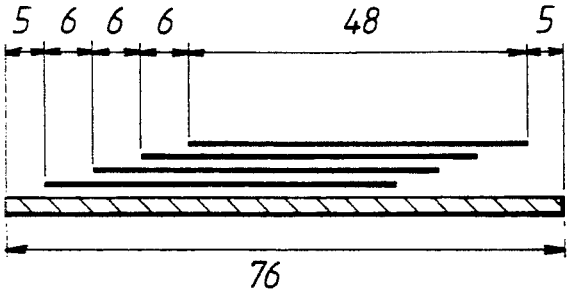
FIGS. 4A, B and C are diagrams showing shingled packs.
Figure 4B:
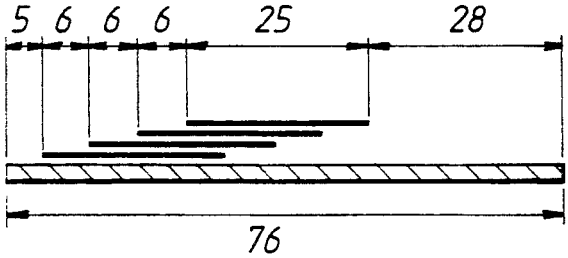

FIG. 4A shows a shingle produced by a conventional slicing machine and jump conveyor when handling the maximum size product that it is set up to produce. With a log of product of height 48 mm and with four slices per pack and with a pack having an extent in the shingling direction of 76 mm it is desirable to leave a 5 mm border so that the pack can be effectively sealed in a downstream vacuum packaging machine. Accordingly, the maximum extent in the shingling direction of the shingle should be 66 mm which, with a 48 mm log height means that the pitch of the shingle should be 6 mm. In a conventional slicing machine and jump conveyor combination the shingling speed of the jump conveyor is set to produce a pitch of 6 mm for all the packs under these circumstances. However, when the slicing machine and jump conveyor are handling a product having a height of only 25 mm when the same shingling speed is used a pack as shown in FIG. 4B is produced with a 5 mm gap at the leading edge but a 28 mm gap at the trailing edge. Such a pack gives the appearance of being only half full to the eventual consumer and this is not preferred.

Figure 4C:
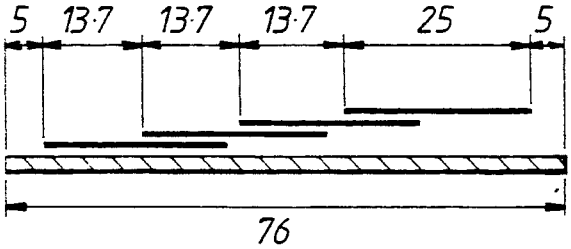

Accordingly, the present slicing machine includes a sensor 10 which has an arm 11 which engages the top of the log 5 immediately adjacent the blade 3 and produces an output proportional to the height of the log 5. This output is used to control the shingle speed so that the shingled pack has a substantially constant length in the shingle direction. Clearly if the log height is 48 mm then a pack identical to that shown in FIG. 4A is produced. However with a log height of 25 mm, as shown in FIG. 4B the control means changes the feed speed to produce a pitch of 13.7 mm between adjacent slices as shown in FIG. 4C so that, once again, a shingled length of 66 mm is produced leaving a 5 mm border around the 76 mm long pack. Of course this flexibility means that if the log height is unexpectedly greater than 48 mm and so would in a conventional system overlap the 5 mm border and so produce a defective package in the vacuum packaging machine, a pitch is correspondingly reduced below 6 mm again to produce a shingle having a length of only 66 mm.

Figure 5:
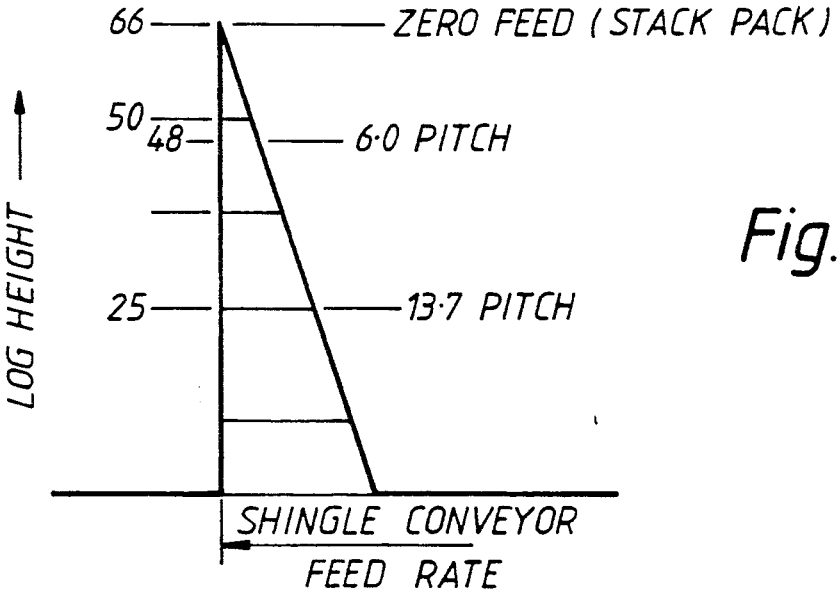
FIG. 5 is a graph illustrating the relationship between feed rate of the jump conveyor and the height of the log.

FIG. 5 is a graph illustrating how the shingling speed varies with the log height to produce packs of constant shingle length.

I claim:

1. In an apparatus comprising: jump conveyor and a slicing machine, wherein said slicing machine includes a slicing blade, said slicing machine including an additional conveyor associated with said jump conveyor, the improvement wherein said slicing machine also includes a sensor, said sensor detecting the height of a log to be cut immediately upstream of said slicing blade and providing an output; and control means to control a low shingling speed of said jump conveyor in accordance with said output of said sensor whereby said combination provides groups of shingled slices of constant length.

2. The combined jump conveyor and slicing machine of claim 1, wherein said jump conveyor comprises:

a first short conveyor, said first short conveyor being located adjacent said slicing blade of said slicing machine and having a length substantially equal to said height capacity of said slicing machine;

a second conveyor, said second conveyor being located downstream of said first conveyor; and, control means to drive the said first and said second conveyors of said jump conveyor independently at the same respective speed or at different respective speeds, said control means also enabling said first conveyor to be driven at high speed in a reverse direction away from said second conveyor to reject slices cut by said slicing blade.

3. The combined jump conveyor and slicing machine of claim 2, wherein said control means calculates the pitch P between adjacent slices of a shingle and hence the shingling speed of said jump conveyor using the following equation:

$$P = \frac{L - H}{n - 1}$$

where L is the required total length of the shingled pack, H is the height of the log and n is the number of slices in each of said groups of shingled slices.

4. A combined jump conveyor and slicing machine of claim 3, wherein said sensor for detecting said height of said log immediately upstream of said slicing blade is formed by a feeler which, in use, engages an upper surface of said log and is connected to one of an encoder and potentiometer.

5. A combined jump conveyor and slicing machine of claim 2, wherein said sensor for detecting said height of said log immediately upstream of said slicing blade is formed by a feeler which, in use, engages an upper surface of said log and is connected to one of an encoder and potentiometer.

6. The combined jump conveyor and slicing machine of claim 1, wherein said control means calculates the pitch P between adjacent slices of a shingle and hence the shingling speed of said jump conveyor using the following equation:

$$P = \frac{L - H}{n - 1}$$

where L is the required total length of the shingled pack, H is the height of the log and n is the number of slices in each of said groups of shingled slices.

7. A combined jump conveyor and slicing machine of claim 1, wherein said sensor for detecting said height of said log immediately upstream of said slicing blade is formed by a feeler which, in use, engages an upper surface of said log and is connected to one of an encoder and potentiometer.

* * * * *